US008087803B2

(12) United States Patent
Zheng

(10) Patent No.: US 8,087,803 B2
(45) Date of Patent: Jan. 3, 2012

(54) LED LAMP

(75) Inventor: Shi-Song Zheng, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 421 days.

(21) Appl. No.: 12/432,783

(22) Filed: Apr. 30, 2009

(65) Prior Publication Data

US 2010/0220488 A1 Sep. 2, 2010

(30) Foreign Application Priority Data

Feb. 27, 2009 (CN) ..... 2009 1 0300606

(51) Int. Cl.
*F21V 29/00* (2006.01)

(52) U.S. Cl. ..... 362/294; 362/373

(58) Field of Classification Search ..... 362/294, 362/373

See application file for complete search history.

(56) References Cited

U.S. PATENT DOCUMENTS 7,959,330 B2 * 6/2011 Hashimoto et al. ..... 362/373

* cited by examiner

*Primary Examiner* — Diane Lee
*Assistant Examiner* — Sean Gramling
(74) *Attorney, Agent, or Firm* — Altis Law Group, Inc.

(57) ABSTRACT

An LED lamp includes a housing, a holder and an LED device pivotally connected with the holder. The LED device includes a cylinder-shaped casing having opposite first and second openings and air venting holes near the first opening. An LED module and a heat dissipating fan are respectively mounted at two ends of a heat sink. The LED module, the heat sink and the heat dissipating fan are assembled together as a unit, which is received in the casing. An airflow generated by the heat dissipating fan is directed into the casing through the second opening. A portion of the airflow is exhausted out of the casing through fins of the heat sink and the first opening, and another portion of the airflow is exhausted out of the casing through the fins and the air venting holes of the casing.

10 Claims, 6 Drawing Sheets

LED LAMP

BACKGROUND

1. Technical Field

The disclosure relates to an LED (light-emitting diode) lamp, and more particularly to an improved LED lamp with a high heat dissipating efficiency.

2. Description of Related Art

An LED lamp utilizes LEDs as a source of illumination, in which current flowing in one direction through a junction region comprising two different semiconductors results in electrons and holes coupling at the junction region and generating a light beam. The LED is resistant to shock and has an almost endless lifetime under specific conditions, making it a popular, cost-effective and high quality replacement for incandescent and fluorescent lamps.

Known implementations of LED modules in an LED lamp make use of a plurality of individual LEDs to generate light that is ample and of satisfactory spatial distribution. However, the plurality of LEDs generate a large amount of heat during operation which can endanger the normal operation of the LED lamp. Therefore, heat dissipation of the LED lamp is a problem inhibiting the application of the LED lamp, which requires to be resolved. For a high brightness LED lamp, a highly efficient heat dissipation device is necessary in order to timely and adequately remove the heat generated by the LED lamp. Otherwise, the brightness, lifespan, and reliability of the LED lamp will be seriously affected.

What is needed, therefore, is an LED lamp which can overcome the limitations described.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE EMBODIMENT

Figure 1:
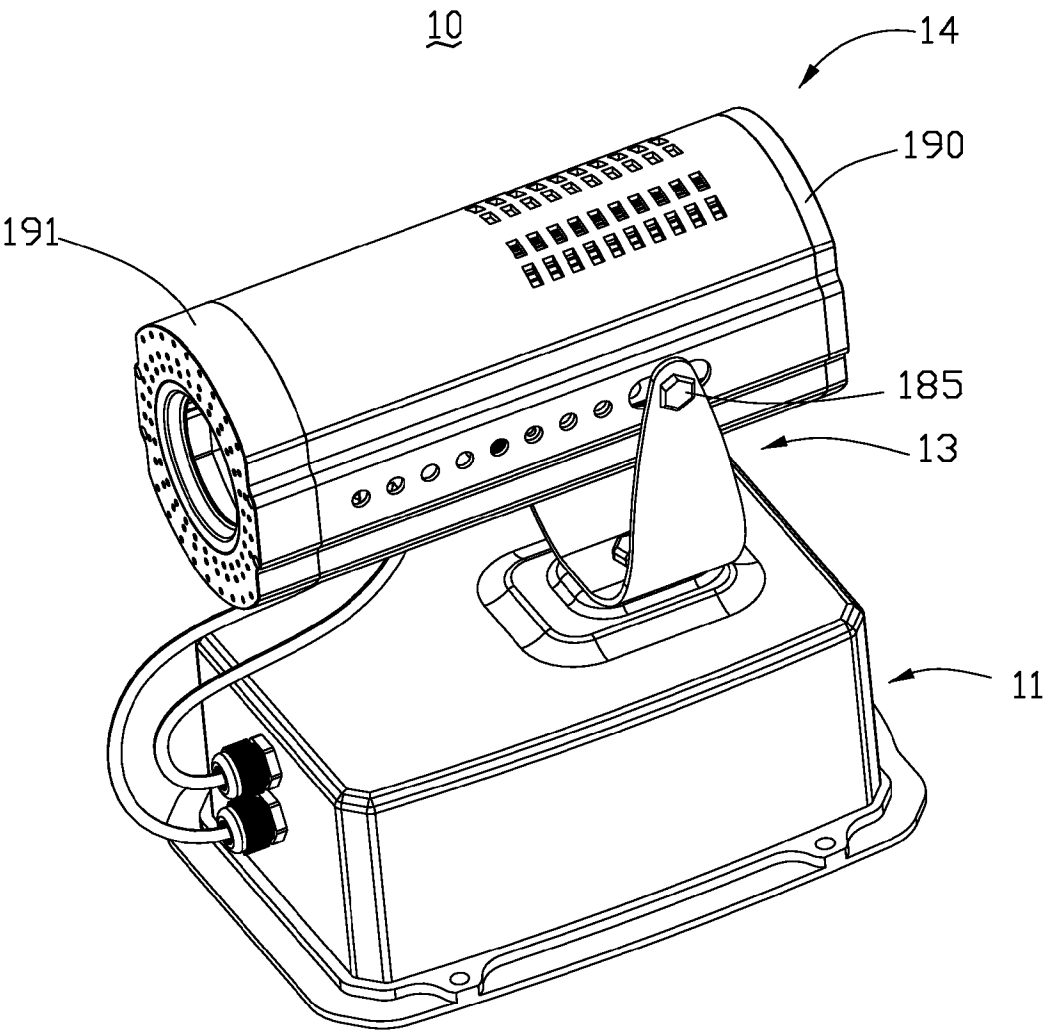
FIG. 1 is an isometric, assembled view of an LED lamp in accordance with an exemplary embodiment of the disclosure.
Figure 2:
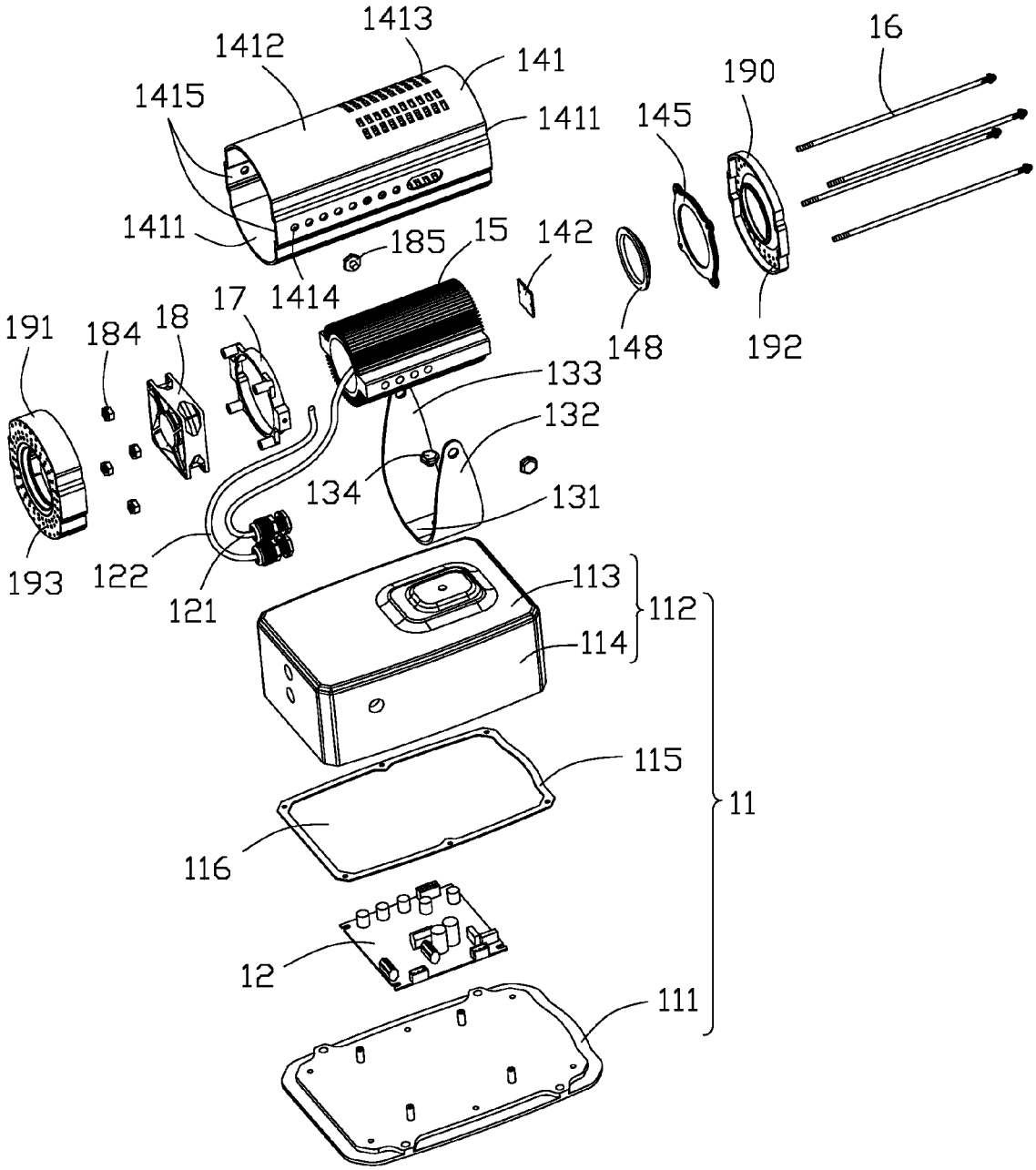
FIG. 2 is an exploded view of the LED lamp of FIG. 1.

Referring to FIGS. 1-2, an LED lamp 10 in accordance with an exemplary embodiment is illustrated. The LED lamp 10 includes a housing 11 at a bottom side thereof, a power driver source 12 received in the housing 11, a holder 13 mounted on the housing 11 and an LED device 14 pivotally connected with the holder 13.

The housing 11 includes a base plate 111 at a bottom side of the housing 11, a cover 112 mounted on the base plate 111 and a rectangle-shaped sealing member 115. The sealing member 115 defines a rectangle-shaped through hole 116 therein. The cover 112 includes a top plate 113 at a top side of the housing 11 and an annular sidewall 114 extending downwardly from an outer peripheral edge of the top plate 113. The sealing member 115 is sandwiched between the base plate 111 and the sidewall 114 of the cover 112 for preventing dust and water from entering into the housing 11.

The holder 13 is generally U-shaped, including a bottom plate 131 mounted on the housing 11 by a screw 134 and two opposite fixing arms 132, 133 extending upwardly from two ends of the bottom plate 131, respectively.

Figure 3:
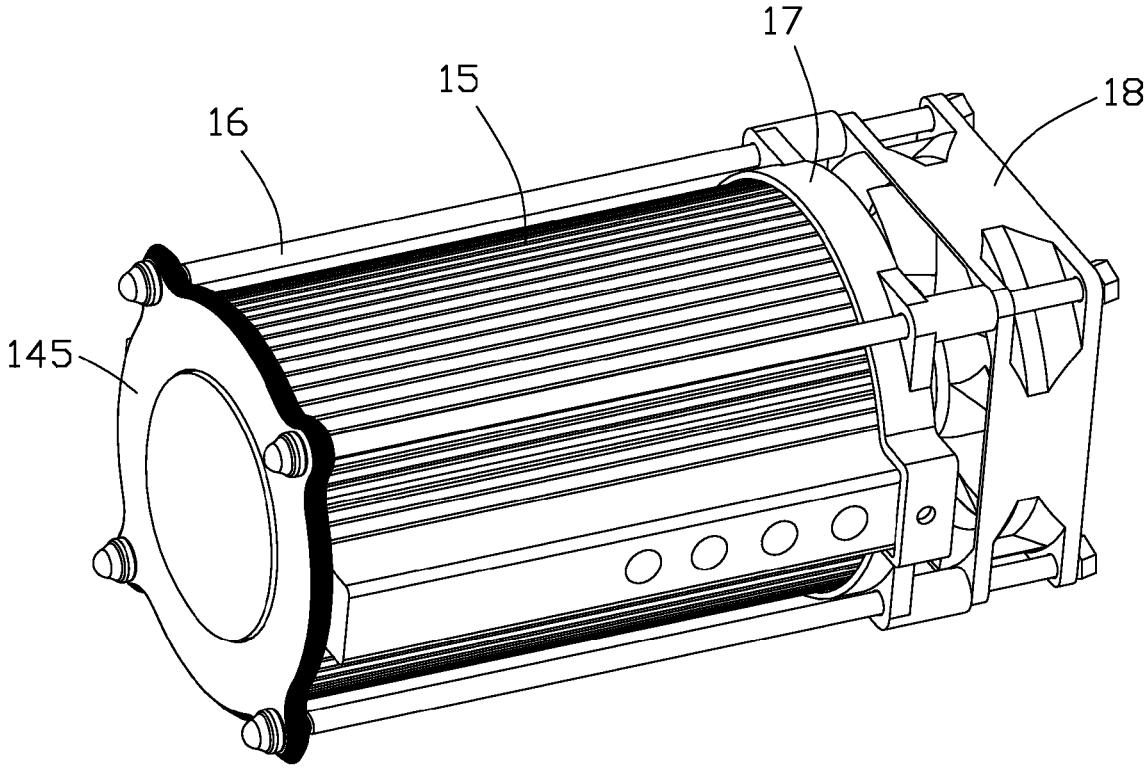
FIG. 3 is an isometric, assembled view of an LED device of the LED lamp of FIG. 2, with some parts thereof removed.
Figure 4:
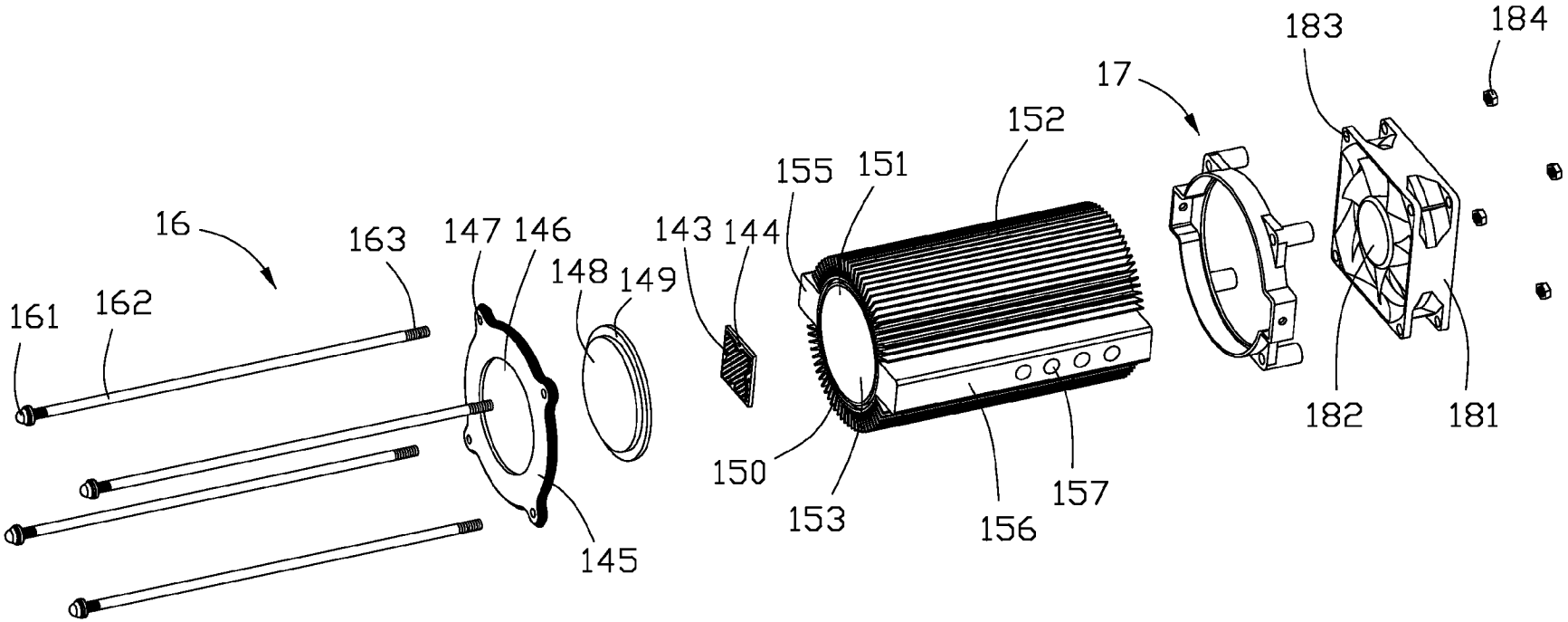
FIG. 4 is an exploded view of the LED device of FIG. 3.
Figure 5:
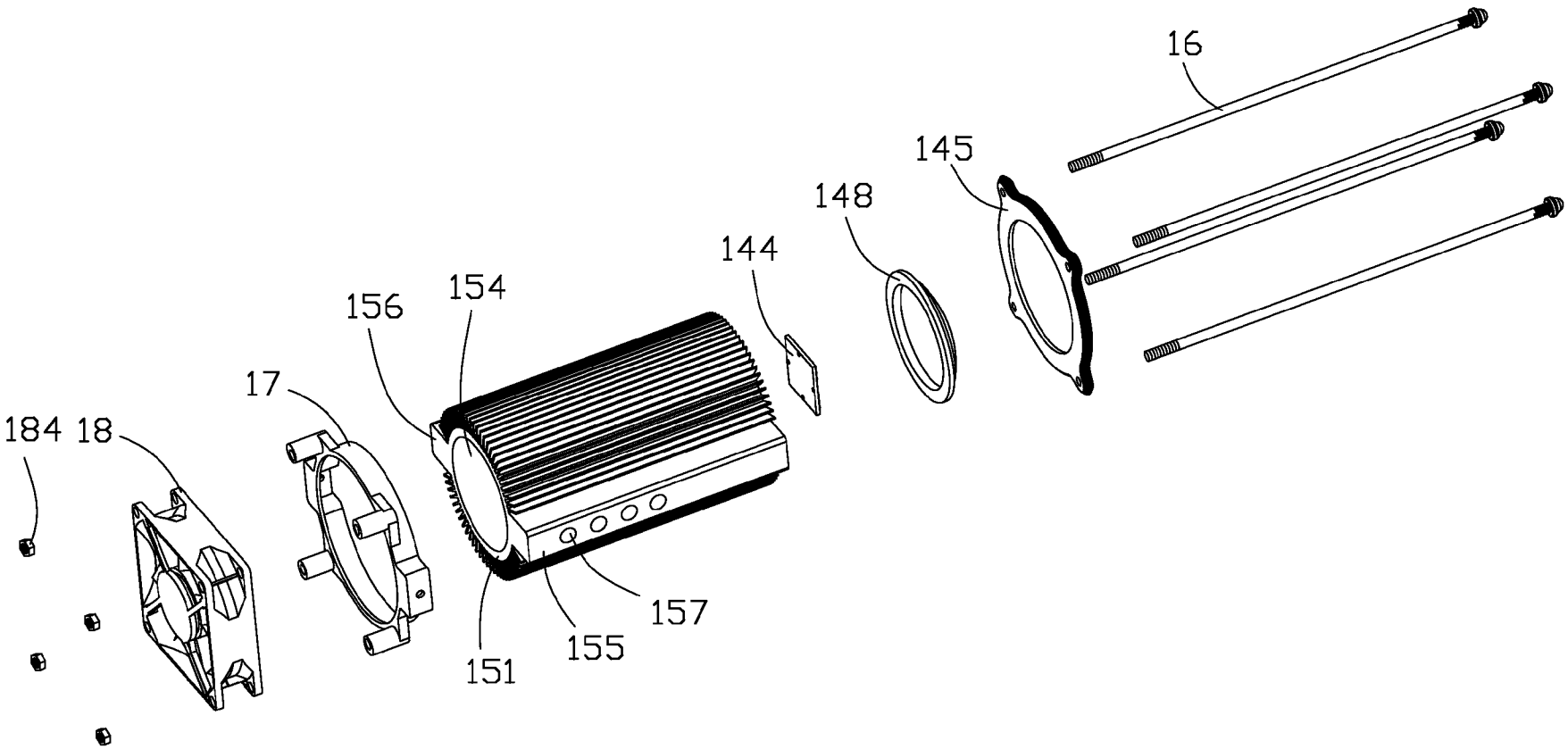
FIG. 5 is an exploded view of the LED device of FIG. 3, viewed from another aspect.

Referring also to FIGS. 3-5, the LED device 14 is pivotally mounted between the two fixing arms 132, 133 of the holder 13 and includes a cylinder-shaped casing 141, a column-shaped heat sink 15 received in the casing 141, an LED module 142 disposed at a right end of the heat sink 15, a fan bracket 17 disposed at a left end of the heat sink 15 and a heat dissipating fan 18 engaged with the fan bracket 17. The casing 141 is disposed between the two fixing arms 132, 133 of the holder 13 and defines two openings 1411 at two axial ends thereof. An inner peripheral wall of the casing 141 defines axially two opposite positioning grooves 1415. A first sealing cover 190 and a second sealing cover 191 are connected with the two axial ends of the casing 141 by screws (not shown) and cover the two openings 1411, respectively. The first sealing cover 190 defines a plurality of air outlet holes 192 and the second sealing cover 191 defines a plurality of air inlet holes 193. An outer circumferential surface 1412 of the casing 141 defines a plurality of air venting holes 1413 for transferring heat generated by the LED module 142 to ambient atmosphere. In the illustrated embodiment, the air venting holes 1413 are provided in the outer circumferential surface 1412 of the casing 141 at a position adjacent to the air outlet holes 192 of the first sealing cover 190.

The heat sink 15 includes a column-shaped body 151 and a plurality of fins 152 extending outwardly and radially from an outer circumference 150 of the body 151. Two opposite rectangle-shaped protrusion bars 155, 156 protrude outwardly from and extend axially along the outer circumference 150 of the body 151. A plurality of fixing holes 157 are defined in each of the protrusion bars 155, 156 and spaced from each other. The heat sink 15 defines a first recess 153 and a second recess 154 at two axial ends thereof. The LED module 142 is mounted in the first recess 153 of the heat sink 15 and includes a printed circuit board 144 and a plurality of LED components 143 mounted on the printed circuit board 144. An optical lens 148 is mounted in the first recess 153 and has a flange 149 attached to the body 151 of the heat sink 15 defining an annular outer edge of the first recess 153. A mounting plate 145 is mounted on the flange 149 of the lens 148. The mounting plate 145 defines a through hole 146 in a center thereof and four positioning holes 147 respectively in four protruding lobes (not labeled) thereof. The lens 148 extends through the through hole 146 of the mounting plate 145. The flange 149 of the lens 148 is sandwiched between the mounting plate 145 and the body 151 of the heat sink 15.

Figure 6:
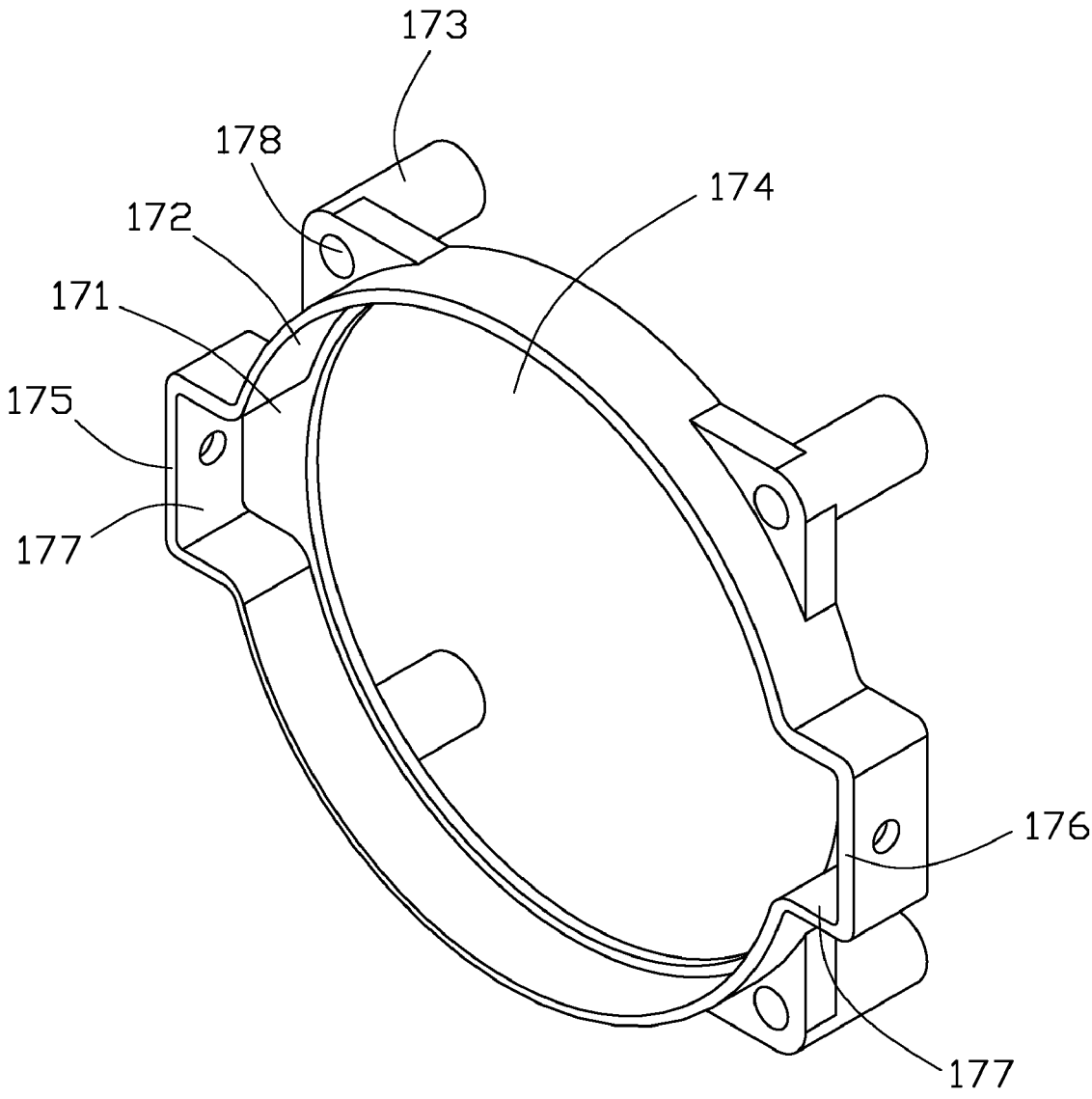
FIG. 6 is an isometric view of a fan bracket of the LED device of FIG. 3.

Referring also to FIG. 6, the fan bracket 17 includes a circular bottom plate 171, a sidewall 172 perpendicular to the bottom plate 171 and four fixing poles 173. The bottom plate 171 defines a through hole 174 in a center thereof. The through hole 174 of the bottom plate 171 has a bore diameter larger than an outer diameter of the body 151. The sidewall 172 extends perpendicularly from an inner edge of the bottom plate 171. Two opposite protrusion sections 175, 176 extend outwardly from two opposite sides of the sidewall 172. Each of the protrusion sections 175, 176 defines a receiving groove 177 corresponding to a protrusion bar 155, 156 of the heat sink 15. The four fixing poles 173 are symmetrically and equidistantly located at an outer periphery of the sidewall 172 of the fan bracket 17, each of which is cylinder-shaped and defines a through hole 178 in a center thereof. When the fan bracket 17 is mounted to the left end of the heat sink 15, the sidewall 172 of the fan bracket 17 surrounds a circumferential surface of the left end of the heat sink 15 and the bottom plate 171 of the fan bracket 17 abuts on an end surface of the left end of the heat sink 15. A left end of each of the protrusion bars 155, 156 is engaged into a corresponding receiving groove 177 of the fan bracket 17, as viewed from FIG. 5.

The heat dissipating fan 18 is mounted to the fan bracket 17 and includes a fan frame 181 and an impeller 182, which is received in the fan frame 181 and faces the heat sink 15. Four through holes 183 are respectively defined at four corners of the fan frame 181. Each of the through holes 183 of the fan frame 181 has a smaller diameter than that of the fixing pole 173. The fixing poles 173 abut on the fan frame 181.

The mounting plate 145, the lens 148, the heat sink 15, the fan bracket 17 and the heat dissipating fan 18 are coaxially arranged with each other and assembled together by four bolts 16. Each of the four bolts 16 includes a head portion 161 at a right end thereof and a thread portion 163 at a left end thereof. A pole portion 162 is disposed between the head portion 161 and the thread portion 163. The head portion 161 has an outer diameter larger than that of the pole portion 162 and larger than a bore diameter of the positioning hole 147 of the mounting plate 145. The pole portion 162 extends through the positioning hole 147 of the mounting plate 145, the through hole 178 of the fixing pole 173 of the fan bracket 17 and the through hole 183 of the fan frame 181 sequentially. The head portion 161 abuts on the mounting plate 145. The thread portion 163 is screwed with a nut 184, which abuts on the fan frame 181. Thus, the mounting plate 145, the lens 148, the heat sink 15, the fan bracket 17 and the heat dissipating fan 18 are compactly assembled together, and then are integrally disposed in the casing 141. The two protrusion bars 155, 156 of the heat sink 15 are received in the two positioning grooves 1415 of the casing 141, respectively. The two protrusion sections 175 of the fan bracket 17 are received in the two positioning grooves 1415 at the left end of the casing 141. The outer circumference 1412 of the casing 141 defines a plurality of mounting holes 1414 corresponding to the fixing holes 157 in the two bars 155, 156 of the heat sink 15. A bolt 185 extends through the fixing arm 132, 133 of the holder 13 and the mounting hole 1414 of the casing 141 and is engaged in the fixing hole 157, thereby pivotably securing the LED device 14 to and between the fixing arms 132, 133 of the holder 13.

In use, the power driver source 12 provides two electrical lines 121, 122 to supply electrical power for the LED module 142 and the heat dissipating fan 18, respectively. An airflow generated by the heat dissipating fan 18 is directed into the casing 141 via the air inlet holes 193 of the second sealing cover 191 and flows toward the heat sink 15. A portion of the airflow is exhausted out of the casing 141 through the air outlet holes 192 of the first sealing cover 190 and another portion of the airflow is exhausted out of the casing 141 through the air venting holes 1413 of the casing 141. A plurality of forced air convection paths are thus established in the LED lamp 10, which extend through the fins 152. Heat generated by the LED components 143 and absorbed by the body 151 of the heat sink 15 is transferred to the fins 152 from which the enforced air convention takes the heat away to the ambient atmosphere. Thus, the heat dissipating efficiency of the LED lamp 10 is improved.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising:

a heat sink having a column-shaped body and a plurality of fins extending outwardly and radially from the body;

an LED module mounted at one end of the heat sink;

a mounting plate attached to the one end of the heat sink;

a fan bracket attached to an opposite end of the heat sink;

a heat dissipating fan secured to the fan bracket; and a plurality of bolts each extending through the mounting plate, the fan bracket and the heat dissipating fan, one end of each of the bolts being engaged with the mounting plate, another end of each of the bolts being engaged with the heat dissipating fan;

wherein a plurality of protrusion bars protrude outwardly from and extend axially along an outer circumferential surface of the body; and wherein the fan bracket defines a plurality of receiving grooves corresponding to the protrusion bars of the heat sink, the fan bracket surrounding a circumferential outer surface of the opposite end of the heat sink, one end of each of the protrusion bar being engaged in a corresponding receiving groove.

2. The LED lamp as claimed in claim 1 further comprising a cylinder-shaped casing, an outer circumferential surface of the casing defining a plurality of air venting holes, wherein the heat sink, the LED module, the heat dissipating fan and the fan bracket are received in the casing.

3. The LED lamp as claimed in claim 2 further comprising a housing and a holder mounted on the housing, the holder comprising a bottom plate mounted on the housing and two fixing arms formed at two opposite ends of the bottom plate, the casing being disposed between the two fixing arms and pivotally connected with the holder.

4. The LED lamp as claimed in claim 3 further comprising two sealing covers located respectively at two axial ends of the casing, one of the sealing covers defining a plurality of air outlet holes, the other one of the sealing covers defining a plurality of air inlet holes, an airflow generated by the heat dissipating fan flowing into the casing via the air inlet holes and flowing out of the casing via the air outlet holes and the air venting holes.

5. The LED lamp as claimed in claim 1 further comprising an optical lens forming a flange around an outer edge thereof, the optical lens covering on the LED module, the mounting plate defining a through hole through a center thereof, the optical lens extending through the through hole of the mounting plate, the flange of the lens being sandwiched between the mounting plate and the heat sink.

6. The LED lamp as claimed in claim 5 further comprising a plurality of nuts corresponding to the bolts, the bolts each comprising a head portion and a thread portion at two ends thereof, respectively, the heat dissipating fan comprising a fan frame defining a plurality of holes corresponding to the bolts, the head portion of each of the bolts abutting on the mounting plate, the thread portion of each of the bolts extending through a corresponding hole of the fan frame and being engaged with a corresponding nut, each of the nuts abutting on the fan frame.

7. An LED lamp comprising:

a housing;

a power driver source received in the housing;

an LED device connected with the housing and energized by the power driver source, the LED device comprising:

a cylinder-shaped casing having two openings at two axial ends of the casing, an outer circumferential surface of the casing defining a plurality of air venting holes;

a heat sink having a column-shaped body and a plurality of fins extending outwardly and radially from the body;

an LED module and a heat dissipating fan being respectively mounted at two ends of the heat sink, wherein the LED module, the heat sink and the heat dissipating fan are received in the casing, an airflow generated by the heat dissipating fan is directed into the casing through one of the two openings, a portion of the airflow is exhausted out of the casing through the other one of the two openings, and another portion of the airflow is exhausted out of the casing through the air venting holes of the casing;

a fan bracket mounted at one end of the heat sink, a mounting plate mounted at the other end of the heat sink, and a plurality of elongate bolts, wherein the bolts extend through the mounting plate, the fan bracket and the heat dissipation fan to mount the LED module and the heat dissipating fan respectively at the two ends of the heat sink; and a first sealing cover mounted at one of the two openings of the casing, a second sealing cover mounted at the other one of the two openings of the casing, the first sealing cover defining therein a plurality of air outlet holes, the second sealing cover defining therein a plurality of air inlet holes, the air venting holes of the casing provided in the outer circumferential surface of the casing being located at a position near the air outlet holes of the first sealing cover, in comparison with the air inlet holes of the second sealing cover.

8. The LED lamp as claimed in claim 7, wherein the LED device is mounted to the housing via a U-shaped holder, the holder includes a bottom plate mounted on the housing and two fixing arms formed at two opposite ends of the bottom plate, and the LED device is pivotally connected between the two fixing arms of the holder.

9. An LED lamp comprising:

a heat sink having a column-shaped body and a plurality of fins extending outwardly and radially from the body;

an LED module mounted at one end of the heat sink;

a mounting plate attached to the one end of the heat sink;

a fan bracket attached to an opposite end of the heat sink;

a heat dissipating fan secured to the fan bracket;

a plurality of bolts each extending through the mounting plate, the fan bracket and the heat dissipating fan, one end of each of the bolts being engaged with the mounting plate, another end of each of the bolts being engaged with the heat dissipating fan; and an optical lens forming a flange around an outer edge thereof, the optical lens covering on the LED module, the mounting plate defining a through hole through a center thereof, the optical lens extending through the through hole of the mounting plate, the flange of the lens being sandwiched between the mounting plate and the heat sink.

10. The LED lamp as claimed in claim 9 further comprising a plurality of nuts corresponding to the bolts, the bolts each comprising a head portion and a thread portion at two ends thereof, respectively, the heat dissipating fan comprising a fan frame defining a plurality of holes corresponding to the bolts, the head portion of each of the bolts abutting on the mounting plate, the thread portion of each of the bolts extending through a corresponding hole of the fan frame and being engaged with a corresponding nut, each of the nuts abutting on the fan frame.

* * * * *